United States Patent [19]

Mills, Jr.

[11] 3,978,854

[45] Sept. 7, 1976

[54] DEMAND REGULATOR

[75] Inventor: Justin W. Mills, Jr., Salisbury, Md.

[73] Assignee: Lif-O-Gen, Inc., Cambridge, Md.

[22] Filed: Apr. 8, 1975

[21] Appl. No.: 566,081

[52] U.S. Cl. ..... 128/142.2

[51] Int. Cl.[2] ..... A62B 7/00

[58] Field of Search..... 128/142.2, 142, 146.5, 128/145.5, 145.8; 137/DIG. 9, 459, 461

[56] References Cited

UNITED STATES PATENTS

| | | | |
|---|---|---|---|
| 2,817,334 | 12/1957 | Sajeck | 137/DIG. 9 |
| 3,083,707 | 4/1963 | Seeler | 128/145.8 |
| 3,145,721 | 8/1964 | Miller | 137/DIG. 9 |
| 3,357,447 | 12/1967 | Zarichansky | 128/142.2 |
| 3,474,785 | 10/1969 | Jansson | 128/145.8 |
| 3,508,542 | 4/1970 | Browner | 128/142.2 |

*Primary Examiner*—Robert W. Michell
*Assistant Examiner*—Henry J. Recla
*Attorney, Agent, or Firm*—Howson and Howson

[57] ABSTRACT

A demand regulator for admitting oxygen into emergency breathing systems, resuscitators, and the like comprising a casing supporting a diaphragm and providing a chamber on one side of the diaphragm communicating with the breathing system. The other side of the diaphragm is open to atmospheric pressure. A tilt valve assembly connected to a source of pressurized oxygen opens into the chamber at one side of the diaphragm and includes an elongated tilt valve stem having a free end disposed proximate the center of the diaphragm. The tilt valve is disposed at an acute angle to the diaphragm and is seated by a light cone spring so that only a slight pressure of the diaphragm on the valve stem is required to dislodge the valve from its seat to permit an inflow of oxygen through the valve. For use in a resuscitator, an exhaust check valve and means for normally actuating the tilt valve while closing the check valve are provided.

5 Claims, 10 Drawing Figures

FIG. 6.
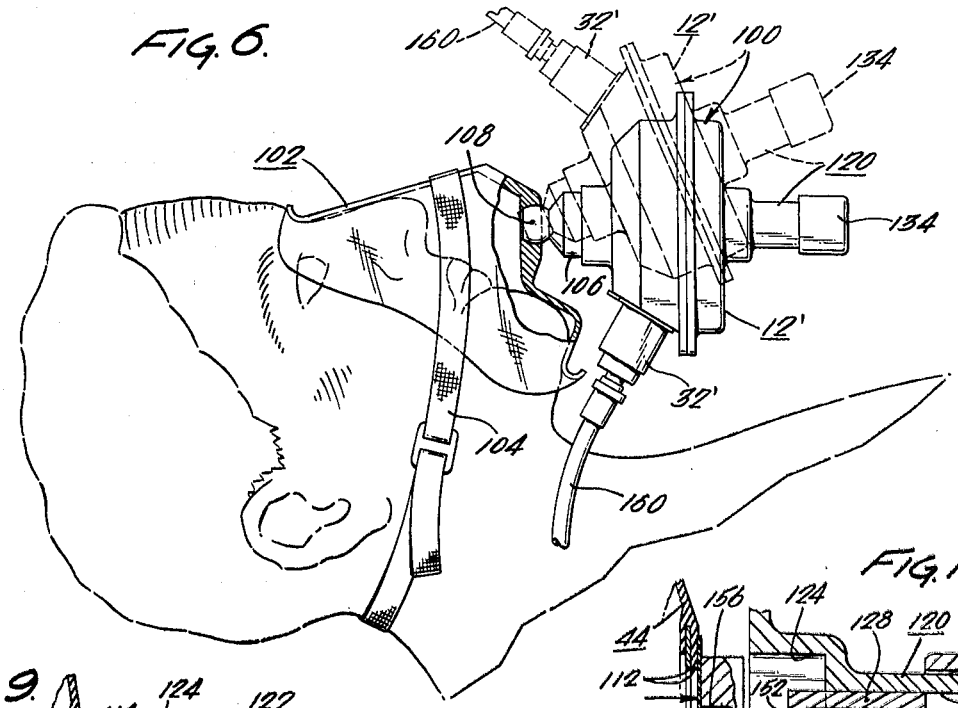
FIG. 10.
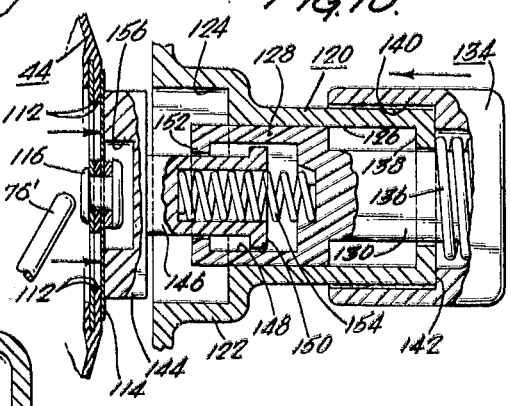
FIG. 9.
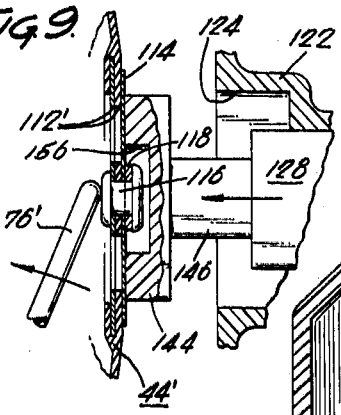
FIG. 7.
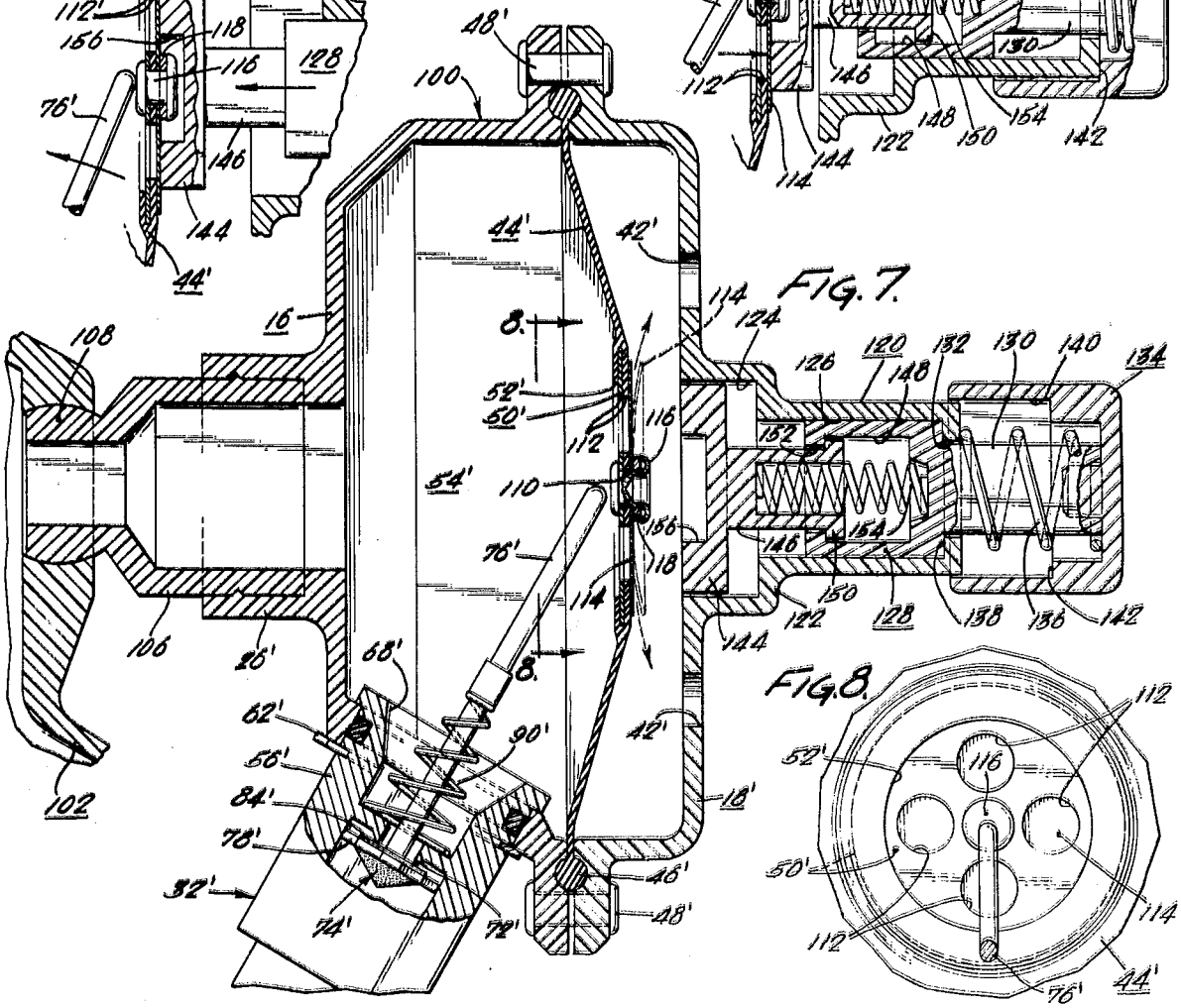
FIG. 8.

DEMAND REGULATOR

The present invention relates generally to gas flow regulating devices and more specifically to a demand regulator for admitting a supplemental flow of a gas such as oxygen into a closed system such as an emergency breathing system, aircraft oxygen system, resuscitator and the like.

An important characteristic of a demand regulator for breathing apparatus is the pressure drop required to actuate the valve controlling the supplemental gas flow. The level of the pressure drop required is a measure of the breathing effort necessary to actuate the valve. Since it is desirable particularly in the case of emergency equipment that a minimal effort be expended to actuate the demand regulator, it is extremely important that the valve actuating pressure drop be as low as possible. In the United States, the Department of Health Education and Welfare has established a maximum permissible pressure drop of 2 inches of water for the actuation of emergency breathing equipment for use in mines. The present demand regulator, due to its novel structure as described below, operates at an extremely low effort level and will function effectively with a pressure drop of less than 1 inch of water.

The present demand regulator in brief comprises a casing supporting a flexible diaphragm, the casing on one side of the diaphragm defining a chamber connected with the breathing system while the opposite side of the diaphragm is exposed to atmospheric pressure. A novel tilt valve assembly opens into the chamber and includes a longitudinally extending valve stem disposed at an acute angle to the diaphragm with the free end thereof disposed proximate the center of the diaphragm. A cone spring seats the valve on an annular valve seat and permits a tilting action of the stem when engaged by the diaphragm to open the valve with only a very light applied force.

For use of the present demand regulator in a resuscitator, an exhaust check valve is provided in the chamber and in the form of a flapper type valve in the diaphragm. A manual actuator for the tilt valve comprises a plunger engaging the diaphragm to actuate the tile valve while simultaneously closing the exhaust valve.

It is accordingly a first object of the present invention to provide a novel demand regulator for breathing systems which requires a minimal pressure drop for actuation.

A further object of the invention is to provide a demand regulator as described of an extremely simple, lightweight design which can be economically manufactured.

Still another object of the invention is to provide a demand regulator as described which is readily adapted to modification for use as a resuscitator.

Additional objects and advantages of the invention will be more readily apparent from the following detailed description of embodiments thereof when taken together with the accompanying drawings wherein:

FIG. 6 is a side elevational view showing a modified form of the present demand regulator utilized as a resuscitator;

FIG. 7 is an enlarged partial sectional view of the modified embodiment shown in FIG. 6;

FIG. 8 is a sectional view taken along line 8—8 of FIG. 7;

FIG. 9 is a partial sectional view showing the embodiment of FIGS. 6–8 in a manually actuated position; and FIG. 10 is a view similar to FIG. 9 showing the operation of the pressure limiting mechanism.

Figure 1:
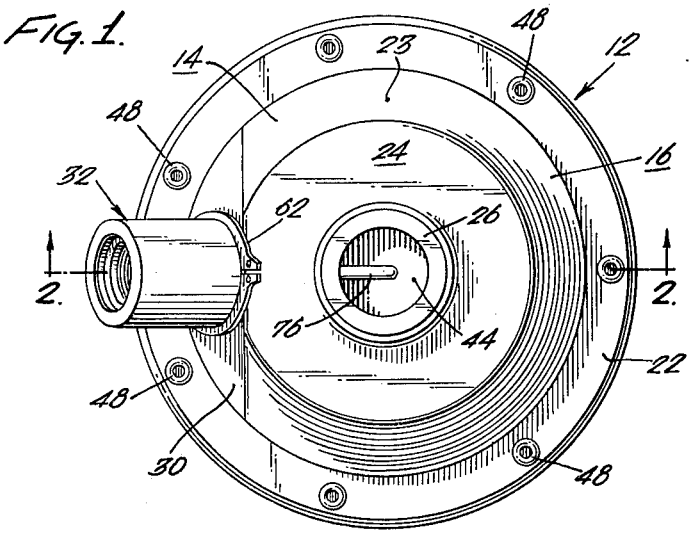
FIG. 1 is an end view of a demand regulator made in accordance with the present invention.

Referring to the drawings and particularly FIGS. 1–5 thereof, a demand regulator generally designated 12 in accordance with the present invention comprises a casing assembly 14 including inner casing member 16 and outer casing member 18. The casing members comprise surfaces of revolution symmetrical about a vertical axis as viewed in FIG. 2. The inner casing member 16 includes a generally cylindrical portion 20 which terminates at one end in an annular radially outwardly extending flange 22. The cylindrical portion 20 at its other end adjoins a conical portion 23 which in turn connects with the circular end portion 24. A hollow cylindrical neck portion 26 extends coaxially from end portion 24 and is threaded at 28 for connection to the input line of a breathing system. A beveled planar surface 30 is provided at one side of the inner casing member 16 and interrupts the symmetry of the casing member to provide a mounting surface for a tilt valve assembly 32, for which purpose a bore 34 is provided in the beveled surface 30.

The outer casing member 18 is characterized by a short cylindrical portion 36 of a diameter equal to that of cylindrical portion 20 of the inner casing member 16. An annular radially outwardly extending flange 38 extends from the cylindrical portion 36 in juxtaposed relation to the inner casing member flange 22. An end portion 40 of the outer housing member 18 is provided with a plurality of apertures 42 to maintain the interior thereof at atmospheric pressure for a purpose described below.

Figure 2:
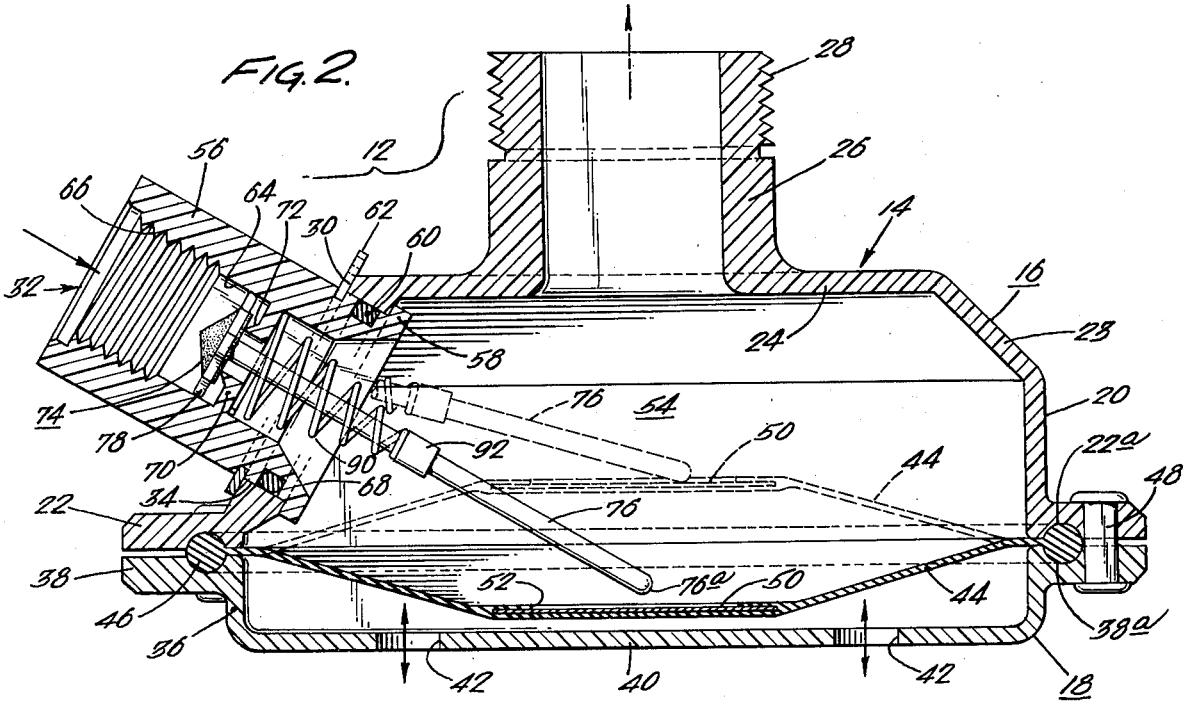
FIG. 2 is an enlarged sectional view taken along line 2—2 of FIG. 1 and showing the interior details of the regulator, a broken line of the view showing the diaphragm and part of the tilt valve assembly in the actuated position.

A resilient diaphragm 44 having a circular peripheral bead 46 is clamped between the flanges 22 and 38 of the inner and outer casing members as illustrated in FIG. 2. Annular grooves **22*a* and 38*a* of semi-circular cross-section are provided respectively in the flanges 22 and 38 within which the bead 46 of the diaphragm is seated. A plurality of eyelets 48 pass through aligned bores in the flanges 22 and 38 to secure the casing members in sealed relationship against the sandwiched diaphragm. The diaphragm includes a rigid insert 50 which is partly exposed on the inner casing member side of the diaphragm by a circular aperture 52** in the diaphragm.

From the foregoing it may be seen that the upper casing member 16 in conjunction with the diaphragm 44 provides a closed chamber 54 which communicates by means of the hollow neck portion 26 with the breathing system intake. The pressure in the chamber 54 is essentially atmospheric although it will fluctuate slightly during the user's breathing cycle as the oxygen is consumed from the system in the case of a closed system with oxygen scrubber, or as the oxygen is exhausted in the case of an open type system wherein the breathing products are discharged. Any fluctuations in pressure within the chamber 54 will result in a movement of the diaphragm 44 toward and away from the inner housing member 16 as shown in FIG. 2. It is this movement of the diaphragm in response to pressure variations within the chamber 54 which actuates the tilt valve assembly 32, the details of which will now be described.

The tilt valve assembly 32 includes a valve housing 56 of a generally hollow cylindrical shape having an external flange 58 at the inner end thereof. The housing 56 is disposed in close fitting relation within the bore 34 of the inner casing member 16 with the flange 58 bearing against the inner wall of the casing member. An O-ring 60 seated within an annular slot in the valve housing 56 seals the valve housing with respect to the bore 34. A retaining ring 62 is cooperatively seated within an annular slot in the valve housing 56 to secure the valve housing in position with the flange 58 engaging the inner wall of the casing member.

The interior of the valve housing 56 is characterized by a generally cylindrical bore 64 having a threaded portion 66 at the outer end thereof for connection to a source of high pressure gas such as oxygen. The opening of the bore 64 into chamber 54 is flared into a conical configuration 68. The bore 64 is interrupted by an annular valve seat support 70 from which coaxially extends a conical valve seat 72.

Figure 5:
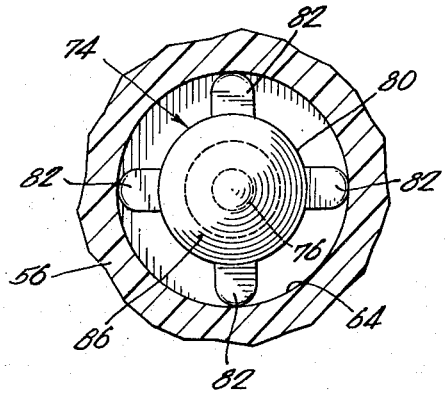
FIG. 5 is a partial sectional view taken along line 5—5 of FIG. 4 showing the configuration of the tilt valve guide.
Figure 4:
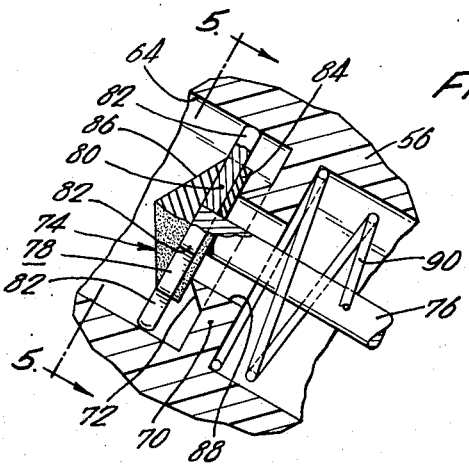
FIG. 4 is an enlarged partial sectional view of a portion of the tilt valve similar to that shown in FIG. 3 with the valve in the closed position.

A tilt valve 74 includes a longitudinally extending valve stem 76 attached to a valve guide 78. The valve guide 78 has a generally circular body portion 80 from which extend spaced ears 82 as shown in FIG. 5. The valve guide 78 is disposed within the bore 64 on the upstream side of the valve seat 72 and the ears 82 maintain the coaxial disposition of the body portion 80 adjacent the valve seat. A resilient seal 84 of circular shape is secured to the valve guide body portion 80 for cooperative engagement with the valve seat 72. A conical shaped flow guide 86 of resilient material is disposed concentrically on the upstream side of the valve guide 78 to prevent flutter of the tilt valve during the flow of high pressure gas therethrough.

Figure 3:
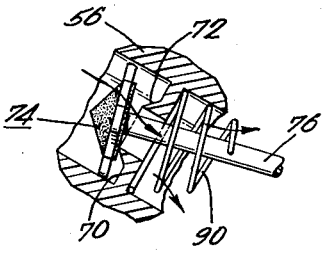
FIG. 3 is a partial sectional view of the remainder of the tilt valve assembly in the actuated position indicated in broken lines in FIG. 2.

The valve stem 76, which is attached to the center of the valve guide 78 and extends perpendicularly therefrom, passes through a passage 88 formed by the valve seat. The passage 88 is several times the diameter of the valve stem 76 to permit a tilting of the valve stem as shown in FIG. 3 to unseat the valve guide 78 and seal 84 from the valve seat. A light cone spring 90 mounted on the valve stem is seated at its larger end against the inner side of the valve seat support 70 and at its smaller end against a spring stop 92 attached to the valve stem 76 at approximately its midpoint. The extending outer end 76*a* of the valve stem is rounded and is disposed proximate the center of the insert 50 of the diaphragm for engagement therewith upon movement of the diaphragm toward the interior of the chamber 54 in the manner shown in broken lines in FIG. 2.

For operation of the regulator, the valve housing 64 is connected with a source of high pressure gas, usually oxygen, and the neck portion 26 of the inner casing member 16 is connected with the breathing system intake. As the pressure in the system and hence the chamber 54 falls as the oxygen supply therein is depleted, the diaphragm 44 is moved by the higher atmospheric pressure toward the valve stem 76. Should the pressure in chamber 54 fall to a sufficient degree, the diaphragm will tilt the valve stem 76 so as to lift the valve guide and seal from the valve seat in the manner shown in FIG. 3 and in broken lines in FIG. 2, permitting oxygen to flow through the passage 88 into the chamber 54 and through the neck portion 26 to the breathing system. When the pressure within the system and chamber 54 have returned to a level equal to or very slightly greater than atmospheric pressure, the diaphragm 44 will move into the position shown in solid lines in FIG. 2 out of engagement with the tilt valve stem. The tilt valve will then close under the influence of the cone spring 90. The cone spring and the force of the pressurized gas upstream of the valve guide will hold the valve closed to prevent gas flow therethrough until the diaphragm once again engages the valve stem and opens the valve.

Tests have shown the present demand regulator to satisfactorily actuate the tilt valve with a pressure differential between atmospheric pressure and the system pressure of less than 1 inch of water. This extremely low actuating pressure differential is a result of the leverage achieved by the long tilt valve stem and the acute angle at which the stem is disposed to the diaphragm. By utilizing a valve stem of appropriate length and a diaphragm of appropriate size, the actuating force can be held to an extremely low figure while still permitting the use of a cone spring of sufficient force to provide good valve closing response. The conical flow guide 86 channels the high pressure flow through the tilt valve in a manner which prevents the flutter or oscillation of the valve.

A modified embodiment of the invention is shown in FIGS. 6–10 wherein the demand regulator previously described is modified to form a resuscitator generally designated 100. As shown in FIG. 6, the resuscitator includes a mask 102 and an adjustable strap 104 adapted to secure the mask in position over the nose and mouth of a patient to whom oxygen is to be administered. A demand regulator 12′ which is a modified form of the regulator 12 described above is connected with the mask by means of a connector 106 having a pivotable ball joint connection 108 with the mask 102. The connector 106 is secured internally within the neck portion 26′ of the regulator 12′ by means of a friction fit. As shown in FIG. 6, the ball joint 108 permits the regulator to be swung or rotated to any desired position for operation.

The regulator 12′ is the same as the regulator 12 except for the addition of an exhaust valve to the diaphragm and the addition of a manual actuator to the outer casing member. Accordingly, the common elements of the regulator 12′, which bear the same identifying numbers with a prime suffix, need not be described in detail. For example, the tilt valve assembly 32′ is identical to the tilt valve assembly 32 both in structure and operation and further description thereof would only be repetitive.

Considering first the modifications to the diaphragm, the diaphragm 44′ includes an insert 50′ exposed to the chamber 54′ by aperture 52′ in the diaphragm. A central bore 110 is provided in the insert and diaphragm along with a plurality of spaced exhaust passages 112 as shown in FIG. 8. An exhaust check valve 114 comprising a thin circular disc preferably of a plastic material is secured against the diaphragm 44 by a rivet 116 disposed in the bore 110. A washer 118 is disposed between the rivet and the exhaust valve. The exhaust valve covers the exhaust apertures 112 and seals the apertures against the passage of air from the atmosphere into chamber 54'. However, the exhaust valve will open and permit the passage of gas from the chamber 54' to the atmosphere when the pressure in chamber 54' exceeds atmospheric pressure by a small predetermined margin.

A manual actuator generally designated 120 is supported on the outer casing member 18' and comprises an actuator housing 122 of a generally hollow cylindrical configuration extending coaxially outwardly from the casing member. The interior of the housing 122 includes a cylindrical bore 124 at the inner end thereof and a smaller cylindrical bore 126 extending coaxially therefrom and containing a plunger 128 in slidable relation. A neck portion 130 of the plunger 128 extends through opening 132 in the end of the housing 122 and is connected to a hollow actuator button 134. A compression spring 136 within the button 134 biases the plunger 128 toward its outermost position shown in FIG. 7 with the shoulder 138 thereof against the end of the housing 122. As shown in FIG. 10, the button 134 by means of a hollow bore 140 therein is adapted to telescope over the housing 122 upon axial inward depression thereof against the force of the spring 136 thereby thrusting the plunger 128 inwardly until the shoulder 142 at the end of bore 140 engages the end of the housing 122.

A valve depressing piston 144 disposed within the bore 124 includes a reduced diameter portion 146 which extends into a hollow chamber 148 in the plunger 128. An outwardly extending flange 150 of the portion 146 cooperatively engages an inwardly extending flange 152 of the plunger 128 to limit the axial movement of the piston 144 with respect to the plunger 128. A compression coil spring 154 holds the piston and plunger in the limit position shown in FIG. 7 with the flanges 150 and 152 thereof in engagement except during conditions of excess pressurization as described below. A counterbore 156 is provided in the inner face of the piston 144 to accommodate the rivet 116 in the valve actuating position as shown in FIG. 9.

For operation of the resuscitator embodiment of the invention, the mask 102 is placed upon the face of the patient and secured thereto by means of adjustable strap 104. A source of oxygen under pressure is connected by conduit 160 to the tilt valve assembly 32' by means of a suitable connector. As illustrated in FIG. 6, the regulator 12' with the conduit 160 attached may be swiveled and rotated by means of the ball joint 108 to achieve the most convenient position for operation of the actuating button 134.

If the patient is not breathing, the button 134 is depressed, causing the inward movement of the plunger 128 and, by action of the spring 154, the piston 144 which engages the diaphragm as shown in FIG. 9 and presses the diaphragm against the valve stem 76' of the tilt valve assembly to open the valve. A flow of oxygen will enter the chamber 54' and pass into the mask 102 and will enter the patient's lungs as artificial respiration is administered. The exhaust valve 114 is held closed by the engagement therewith of the piston 144 as shown in FIG. 9.

Should the plunger 134 be depressed for too long a period, the oxygen pressure in the chamber 54' and the mask 102 may reach a level which could be injurious to the patient. Means are accordingly provided for limiting the pressure buildup in the mask and chamber, which means comprises the permissible telescoping of the piston 144 and plunger 128 as shown in FIG. 10 by compression of the spring 154. This telescoping permits the diaphragm to move away from the tilt valve stem 76', closing off further flow of oxygen despite the fully depressed position of the button 134. The spring 154 must accordingly be chosen to permit this pressure limiting action at a safe chamber pressure.

During the initial rescue efforts, the button 134 is depressed as the patient's lung cavity is expanded to force oxygen into the patient's lungs. The button is released as the patient's lung cavity is compressed to permit the exhaustion of gases through the exhaust valve 114 and casing apertures 42'. This cycle is usually repeated until the patient begins his natural breathing cycle at which point the depression of the button can be discontinued and the demand regulator will function automatically to supply oxygen as needed. Upon breathing in, the exhaust valve 114 will automatically close and the diaphragm will engage the tilt valve to admit oxygen as required. Upon breathing out, the tilt valve will close as the diaphragm moves outwardly and the exhaust valve will automatically open.

The simplicity of the present demand regulator is an important factor in its suitability for use in the resuscitator mode. Conventional resuscitating equipment is extremely complicated, expensive and subject to malfunction upon introduction of foreign matter thereto. Since victims requiring resuscitation typically disgorge the contents of their stomach or lungs into the resuscitator as they begin breathing, it is highly desirable that the resuscitator be of a simple, easily cleaned and overhauled construction.

The present demand regulator because of the unique mechanical leverage arrangement by which the valve is opened has been found to function effectively over a substantial range of input pressures, for example 25 psi to 75 psi. Conventional demand regulators can only effectively cope with a much smaller input pressure range, for example 35 psi to 45 psi. The present regulator accordingly can operate effectively despite a considerable error in the first stage regulator controlling the supply pressure.

It is believed that the present regulator due to its extremely low actuating pressure differential characteristic, may be effectively employed as a substitute for the conventional but extremely hazardous oxygen tent commonly employed in hospital treatment. The inherent dangers of oxygen saturation of the patient's hair, clothing, bedclothes and mattress are not obvious to untrained personnel and have caused flash fires. The use of a demand regulator of the present type at bedside in conjunction with a mask would almost totally eliminate the serious hazard presented by the conventional tent, would make the patient more accessible for monitoring his condition, and would be psychologically less confining than the all-enveloping tent.

The present regulator would also be well adapted for use with aircraft breathing systems, emergency breathing systems for use in industry, mining, fire departments, and, in general, any oxygen deficient environment. The low actuating effort required is a particular advantage for systems wherein a continuous use can be expected, such as aircraft breathing systems, or for uses wherein the user is apt to be in a weakened condition, such as the victim of a near drowning, electrical shock, etc.

Manifestly, changes in details of construction can be effected by those skilled in the art without departing from the spirit and the scope of the present invention.

I claim:

1. A resuscitator comprising a casing, a flexible diaphragm disposed within said casing, said casing and diaphragm defining a closed chamber adjacent one side of said diaphragm, the other side of said diaphragm being open to atmospheric pressure, an aperture in said casing opening into said chamber, a breathing mask, a conduit extending between said mask and said aperture to connect said mask with said chamber, a tilt valve assembly in said casing for introducing a pressurized gas into said chamber in response to the pressure differential across said diaphragm, said tilt valve assembly including an elongated valve stem extending into said chamber with the free end of said valve stem disposed proximate said diaphragm, the inward movement of said diaphragm upon a reduction in pressure in said chamber causing engagement of said diaphragm with said valve stem and an opening of said valve to admit pressurized gas to said chamber, an exhaust valve in said diaphragm, and manually actuatable plunger means on said casing for engaging said diaphragm to simultaneously close said exhaust valve and displace said diaphragm against said tilt valve to actuate said valve.

2. The invention as claimed in claim 1 wherein said exhaust valve comprises an aperture in said diaphragm, and a thin flexible sheet secured to said diaphragm on the side thereof open to atmospheric pressure.

3. The invention as claimed in claim 2 wherein said plunger means is adapted to engage said exhaust valve sheet and hold said sheet over said aperture diaphragm during manual actuation of the regulator.

4. The invention as claimed in claim 3 wherein said plunger means includes a plunger and a piston telescopically connected therewith, said piston engaging said diaphragm upon actuation of said plunger, and spring means permitting a telescoping of said piston into said plunger to allow displacement of said diaphragm and disengagement of said diaphragm from said valve stem upon a predetermined pressure condition of said chamber.

5. The invention as claimed in claim 4 including spring means for biasing said plunger away from said diaphragm.

* * * * *